US006098259A

United States Patent [19]

Huang

[11] Patent Number: 6,098,259

[45] Date of Patent: Aug. 8, 2000

[54] APPARATUS FOR CONTINUOUSLY PRODUCING JINGLING BELLS

[76] Inventor: Chung-Shyan Huang, P.O. Box 63-247, Taichung, Taiwan

[21] Appl. No.: 09/264,493

[22] Filed: Mar. 8, 1999

[51] Int. Cl.[7] ..... B23P 23/04

[52] U.S. Cl. ..... 29/33 K; 29/899.1; 29/896.2; 72/404

[58] Field of Search ..... 29/899.1, 34 C, 29/896.2, 896.22, 33 K, 564.7, 34 R; 72/404, 333, 356

[56] References Cited

U.S. PATENT DOCUMENTS

| | | | |
|---|---|---|---|
| 122,679 | 1/1872 | Tencate | 116/170 |
| 183,605 | 10/1876 | Tucker | 116/170 |
| 203,675 | 5/1878 | Tucker | 29/896.22 |
| 968,789 | 8/1910 | Olb | 29/896.2 |
| 1,266,485 | 5/1918 | Kingston | 29/899.1 |
| 2,568,190 | 9/1951 | Frankel et al. | 29/896.22 |
| 3,731,359 | 5/1973 | Glenn | 29/899.1 |
| 4,088,005 | 5/1978 | Starr | 72/404 |
| 4,180,008 | 12/1979 | Nakamoto | 29/896.2 |
| 5,297,324 | 3/1994 | Su | 29/896.2 |
| 5,485,664 | 1/1996 | Huang | 72/404 |

FOREIGN PATENT DOCUMENTS

| | | | |
|---|---|---|---|
| 63781 | 8/1892 | Germany | 29/899.1 |

*Primary Examiner*—William Briggs
*Assistant Examiner*—Erica D. Ergenbright
*Attorney, Agent, or Firm*—Alan Kamrath; Oppenheimer Wolff & Donnelly LLP

[57] ABSTRACT

An apparatus for continuously producing jingling bells includes an upper mold plate and a lower mold plate. The upper mold plate includes a number of punch pins for punching a material web into jingling bells. A cutter is provided on the upper mold plate to cut an iron wire to thereby form a jingling member. The jingling member falls into a flower-like semi-product before closing the flower-like semi product. The lower mold plate includes a rotating wheel rotatably mounted thereto. The rotating wheel includes a number of closing holes for receiving the flower-like semi-product to be closed. An ejection pin provided on the upper mold plate ejects the jingling bell after formation.

11 Claims, 10 Drawing Sheets

APPARATUS FOR CONTINUOUSLY PRODUCING JINGLING BELLS

BACKGROUND OF THE INVENTION

1. Field of the Invention

The present invention relates to an apparatus for continuously producing jingling bells.

2. Description of the Related Art

Jingling bells are widely used and particularly popular during Christmas. Formation of a jingling bell requires several steps including shallow punching, deep punching, tie-piece formation, formation of wings, straightening the wings, adding a jingling member, and punching the wings to enclose the jingling member. These steps are executed by several separate molds and thus require troublesome insertion and removal of the semi-product of the jingling bell into and from the molds. In addition, insertion of the jingling member requires manual operation. All of these result in a relatively high cost in the labor, machines and the molds. The present invention is intended to provide an apparatus for continuously producing jingling bells that mitigates and/or obviates the above problems.

SUMMARY OF THE INVENTION

It is a primary object of the present invention to provide an apparatus for continuously producing jingling bells.

The apparatus in accordance with the present invention includes an upper mold assembly and a lower mold assembly, the upper mold assembly comprising:

an upper mold seat having a front section and a rear section, a front punch board fixed to the front section of the upper mold seat, a shallow punch pin, a deep punch pin, a tie-piece punch pin, and a wings-punch pin being mounted to the front punch board in sequence, and a rear punch board fixed to the rear section of the upper mold seat, a straightening punch pin, a jingling member cutter, a closing punch pin, and an ejection pin being mounted to the rear punch board in sequence, the lower mold assembly comprising:

a lower mold seat including a front section, a rear section, an ejection notch, and a hole, a first mold plate, a second mold plate, and a third mold plate being securely mounted to the front section of the lower mold seat and stacked from top to bottom in sequence, the first mold plate including a shallow groove, a deep groove, a tie-piece punch groove, and a wings-punch hole arranged in sequence in an upper side thereof and respectively located below the shallow punch pin, the deep punch pin, the tie-piece punch pin, and the wings-punch pin, the first mold plate including a first end that defines a material inlet and a second end that defines a waste material outlet, the second mold plate including a material groove in an upper side thereof and below the wings-punch hole in the first mold plate, a fourth mold plate, a fifth mold plate, a sixth mold plate, and a seventh mold plate being securely mounted to the rear section of the lower mold seat and stacked from top to bottom in sequence, the fourth mold plate and the sixth mold plate including first aligned holes that are aligned with the closing punch pin, the fifth mold plate including a track aligned with the first aligned holes of the fourth mold plate and the sixth mold plate, the fourth mold plate, the fifth mold plate, and the sixth mold plate further including second aligned holes that are aligned with the cutter, the fourth mold plate further including a transverse hole communicated with the first hole thereof, an iron wire being fed to the second hole of the fourth mold plate via the transverse hole, the seventh mold plate including an arcuate recess below the holes of the fourth mold plate, the fifth mold plate, and the sixth mold plate, a rotating wheel rotatably mounted to the lower mold seat and including a plurality of annularly disposed closing holes, each said closing hole receiving a closing sleeve therein, and some of the closing holes being located in the arcuate recess of he seventh mold plate, a disc secured between the rotating wheel and the lower mold seat and including a through-hole and an ejection hole, each of the through hole and the ejection hole being aligned with an associated said closing hole in the rotating wheel, and an anchor member received in the hole of the lower mold seat and the through hole in the disc, the upper mold seat being reciprocatingly movable through an upward stroke and a downward stroke relative to the lower mold seat, whereby a material web is fed to pass through the upper side of the first mold plate via the material inlet and exits via the waste material outlet, and in the downward stroke of the upper mold seat: (a) the shallow punch pin punches the material web to form a shallow depression; (b) the deep punch pin punches the shallow depression of the material web formed in a previous punching procedure to form a deep depression; (c) the tie-piece punch pin punches the deep depression of the material web formed in the previous punching procedure to form a tie-piece in the deep depression; (d) the wings-punch pin punches the deep depression of the material web formed in the previous punching procedure to form a star-shape semi-product for a jingling bell, the star-shape semi-product separates from the material web and then falls on the material path of the second mold plate, further comprising:

means for displacing the star-shape semi-product in the material path of the second mold plate into the track of the fifth mold plate during the upward stroke of the upper mold seat, and means for driving the rotating wheel to rotate along a direction by a distance equal to a distance between the centers of two adjacent said closing holes during the upward stroke of the upper mold seat, whereby in the downward stroke of the upper mold seat: (e) the straightening punch pin punches the star-shape semi-product formed in the previous punching procedure to form a flower-like semi-product that then falls into the closing sleeve in the associated said closing hole via the hole of the sixth mold plate; (f) the rotating wheel is rotated along the direction by said distance such that the semi-product formed in the previous punching procedure is shifted to a position below the second hole of the sixth mold plate; (g) the cutter cuts the iron wire to thereby form a jingling member that then falls into the flow-like semi-product; (h) the flower-like semi-product with the jingling member formed in the previous punching procedure is shifted to a position above the through-hole of the disc during the rotational movement of the rotating wheel; (i) the closing punch pin punches and thus closes the flower-like semi-product with the jingling member therein to thereby form a jingling bell; (j) the jingling bell formed in the previous punching procedure is shifted to a position above the ejection hole of the disc during the rotational movement of the rotating wheel; and (k) the ejecting pin ejects the jingling bell in the associated closing hole above the ejection hole out of the rotating wheel to thereby eject the jingling bell via the ejection notch.

A second cutter is mounted to the upper mold seat and beside the front punch board. The second cutter forms a groove in an upper side of the material web during the downward stroke of the upper mold seat to avoid deformation of the material web in subsequent punching procedures.

A displacing pin may be provided on the rear punch board and between the closing punch pin and the ejecting pin. The displacing pin moves the jingling bell to a position flush with an underside of the rotating wheel.

A spare ejecting pin may be provided on the rear punch board and behind the ejecting pin. The disc includes a spare ejection hole located below the spare ejection pin and aligned with the associated closing hole.

The displacing means for the star-shape semi-product includes a push seat having a push member slidable along the material path of the second mold plate. The push seat further includes at least one rotor rotatably attached thereto. The upper mold plate further includes at least one actuating member that impinges on said at least one rotor during the downward stroke of the upper mold seat to move the push seat away from the second mold plate. At least one spring returning spring is attached between the fifth mold plate and the push seat for moving the push seat toward the second mold plate during the upward stroke of the upper mold seat such that the push member pushes the star-shape semi-product in the material path into the track of the fifth mold plate.

The fifth mold plate further comprises a stop for stopping the star-shape semi-product pushed by the push member at a location below the first hole of the fourth mold plate.

In addition, means for is provided for guiding the upward stroke and the downward stroke of the upper mold seat relative to the lower seat. The guiding means includes two spaced tubes on the upper mold seat and two spaced guide rods on the lower mold seat slidably extended through the tubes.

A spring may be mounted around the anchor and a padding sleeve may be mounted in the through-hole of the disc and between the anchor and the spring.

In a preferred embodiment of the invention, the driving means includes:

an actuating block mounted to the upper mold seat and beside the rear punch board, a driving member including a first end rotatably mounted to the lower mold seat and having a rotating axis coincident with that of the rotating wheel, the first end of the driving member being located above the rotating wheel, the driving member further including a second end to which a rotor is rotatably mounted, a hole being defined in the driving member and aligned with one of the closing sleeves in the rotating wheel, a spring-biased driving rod having an upper end slidably received in the hole of the driving member and including a dome in a portion of a lower end thereof, the dome being extended into the closing sleeve aligned with the hole, the rotor being be impinged by the actuating block (on the upper mold seat during the downward stroke of the upper mold seat to make the driving member turn in a direction opposite to the rotational direction of the rotating wheel, such that the dome of the driving rod allows the lower end of the driving rod to move from the closing sleeve in one of the closing holes to the closing sleeve in the adjacent closing hole, and a spring attached between the driving member and the third mold plate for returning the driving rod such that the rotating wheel is rotated in the direction by the distance during the upward stroke of the upper mold seat.

The fourth mold plate, the fifth mold plate, and the sixth mold plate include third aligned holes that are aligned with the associated closing sleeve. A spring-biased positioning member includes an upper end slidably received in the third hole of the fourth mold plate and a dome in a portion of a lower end thereof, the dome being extended into the closing sleeve aligned with the third holes. The dome of the positioning member allows the lower end of the positioning member to move from the closing sleeve in one of the closing holes to the closing sleeve in the adjacent closing hole when the rotational wheel is rotated in the direction, thereby assuring the rotational wheel is displaced by the distance.

Other objects, advantages, and novel features of the invention will become more apparent from the following detailed description when taken in conjunction with the accompanying drawings.

DETAILED DESCRIPTION OF THE PREFERRED DESCRIPTION

Figure 1:
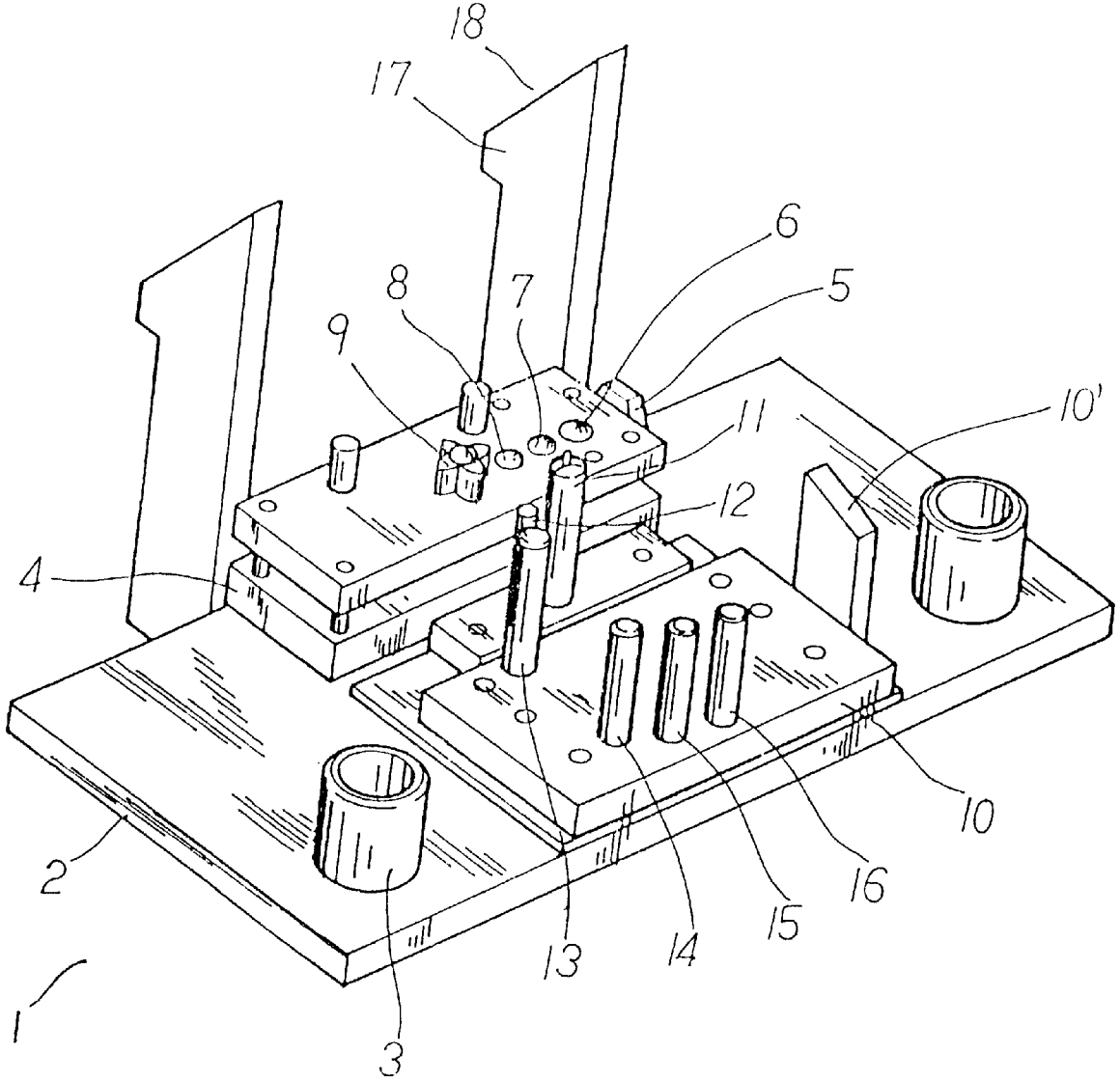
FIG. 1 is a bottom perspective view of an upper mold assembly of an apparatus for continuously producing jingling bells in accordance with the present invention.
Figure 2:
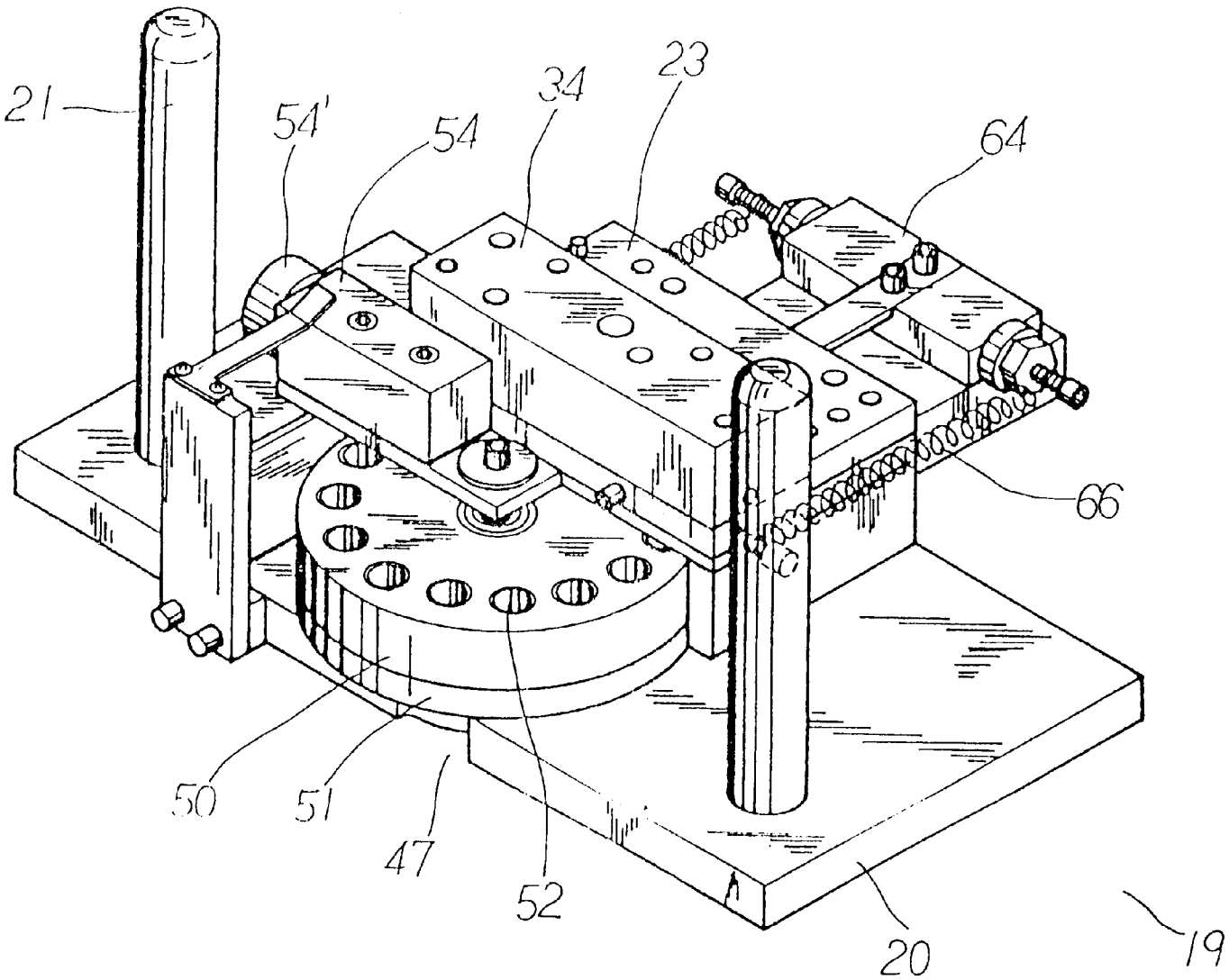
FIG. 2 is a perspective view of a lower mold assembly of the apparatus for continuously producing jingling bells in accordance with the present invention.

Referring to the drawings and initially to FIGS. 1 and 2, an apparatus for continuously producing jingling bells in accordance with the present invention generally includes an upper mold assembly (FIG. 1) and a lower mold assembly (FIG. 2). The upper mold assembly includes an upper mold seat 2 having a pair of tubes 3 provided thereon. Fixed to a front section of the upper mold seat 2 is a front punch board 4 to which a shallow punch pin 6, a deep punch pin 7, a tie-piece punch pin 8, and a wings-punch pin 9 are mounted in sequence. A cutter 5 is mounted to the upper mold seat 2 and beside the front punch board 6. Fixed to a rear section of the upper mold seat 2 is a rear punch board 10 to which a straightening punch pin 11, a jingling member cutter 12, a closing punch pin 13, a displacing pin 14, an ejecting pin 15, and a spare ejecting pin 16 are mounted in sequence. An actuating block 10' is mounted to the upper mold seat 2 and beside the rear punch board 10. In addition, two actuating members 17 are secured to a front end of the upper mold seat 2 and each include a slanted guiding face 18.

Figure 3:
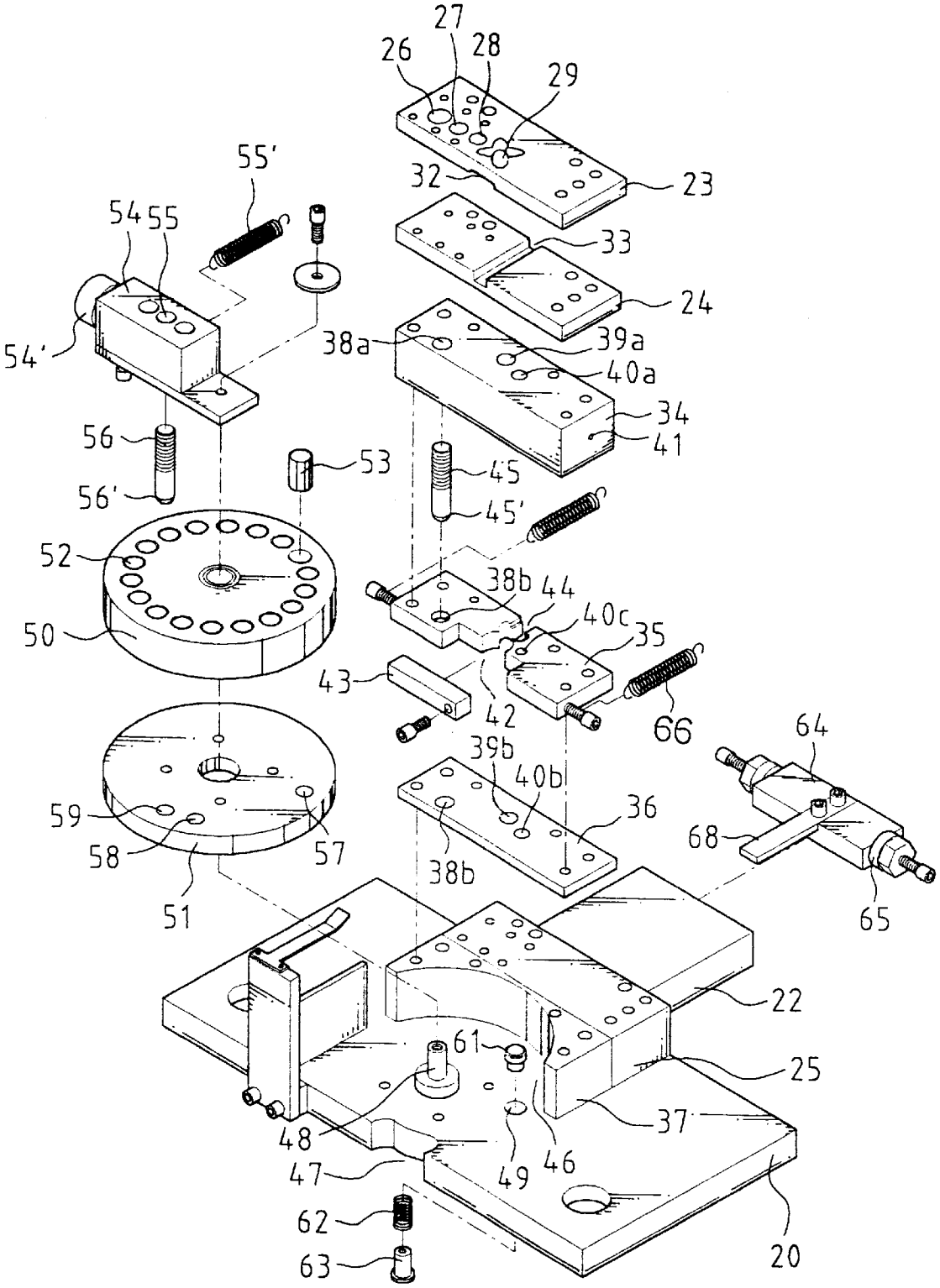
FIG. 3 is an exploded perspective view of the lower mold assembly of the apparatus for continuously producing jingling bells in accordance with the present invention.

Referring to FIGS. 2 and 3, the lower mold assembly 19 includes a lower mold seat 20 with a pair of guide rods 21 slidably extended through the tubes 3 to guide vertical movements of the upper mold seat 2 relative to the lower mold seat 20. A seat 22 is extended from a front side of the lower mold seat 20. An ejection notch 47 is defined in a rear side of the lower mold seat 20. An axle 48 is formed on a rear section of the lower mold seat 20. Adjacent to the axle 48 is a through-hole 49, which will be described later. A first mold plate 23, a second mold plate 24, and a third mold plate 25 are securely mounted to a front section of the lower mold seat 2 and stacked from top to bottom in sequence. The first mold plate 23 includes a shallow groove 26, a deep groove 27, a tie-piece punch groove 28, and a wings-punch hole 29 arranged in sequence and respectively located below the shallow punch pin 6, the deep punch pin 7, the tie-piece punch pin 8, and the wings-punch pin 9. An end of the first mold plate 23 defines a material inlet 30 and the other end of the first mold plate 23 defines a waste material outlet 31. A guide groove 32 is defined in an underside of the first mold plate 23 and communicates with the wings-punch hole 29. The second mold plate 24 includes a material groove 33 in an upper side thereof and below the guide groove 32 in the first mold plate 23. The third mold plate 25 is secured to the front section of the lower mold seat 20.

Still referring to FIGS. 2 and 3, a fourth mold plate 34, a fifth mold plate 35, a sixth mold plate 36, and a seventh mold plate 37 are securely mounted to a rear section of the lower mold seat 20 and stacked from top to bottom in sequence. The fourth mold plate 34 and the sixth mold plate 36 include aligned holes 39*a* and 39*b* that are aligned with the closing punch pin 11 of the upper mold seat 2. The fourth mold plate 34 and the sixth mold plate 36 further include aligned holes 40*a* and 40*b*. The fourth mold plate 34, the fifth mold plate 35, and the sixth mold plate 36 include aligned holes 38*a*, 38*b*, and 38*c*. The fourth mold plate 34 further includes a transverse hole 41 communicated with the hole 40*a*. The fifth mold plate 35 comprises two separate blocks each of which is connected to a push seat 64 by a spring 66. As can be seen from FIG. 3, the blocks include mutually faced sides each having a notch 42 in a first end thereof for receiving a stop 43. The other ends of the mutually faced sides of the blocks define a track 44 that is flush with the material path 33 in the second mold plate 24 such that a wing-like raw material of a jingling bell is passable through the track 44. A spring-biased positioning rod 45 has an upper end slidably received in the hole 38a of the fourth mold plate 34 and includes a dome 45' in a portion of a lower end thereof.

Figure 6:
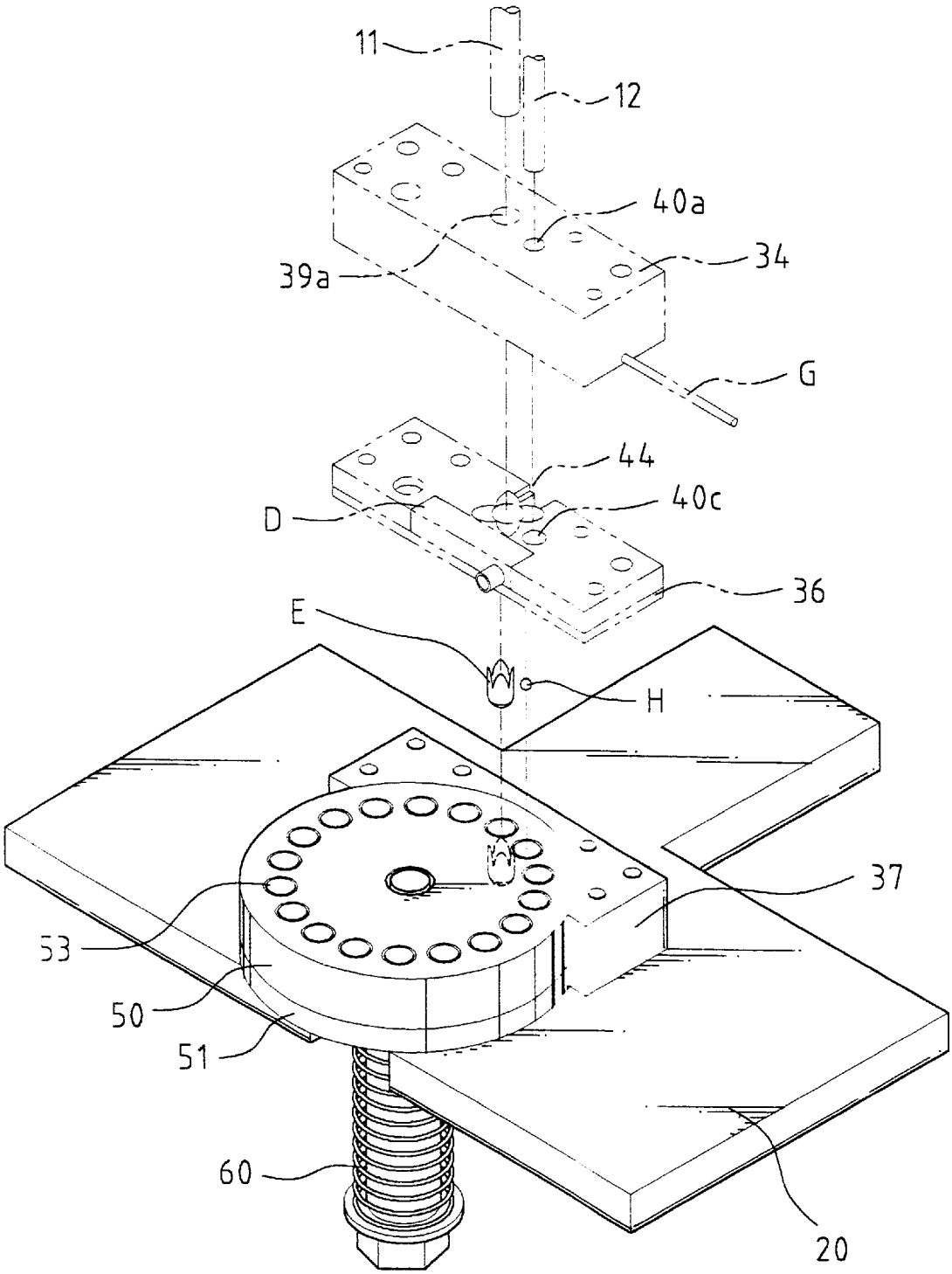
FIG. 6 is a perspective view of a rotating wheel of the lower mold assembly, illustrating adding of a jingling member.

The sixth mold plate 36 is secured to the seventh mold plate 37, which, in turn, is secured to the rear section of the lower mold seat 20. The seventh mold plate 37 includes an arcuate recess 46. A rotating wheel 50 is rotatably mounted to the axle 48 and includes a number of annularly disposed closing holes 52, each closing hole 52 receiving a closing sleeve 53 therein. A driving member 54 includes a first end rotatably mounted to the axle 48 and a second end to which a rotor 54' is rotatably mounted. The rotor 54' may be impinged by the actuating block 10' on the upper mold seat 2 to make the driving member 54 turn, which will be described later. A spring 55' is attached between the driving member 54 and the third mold plate 25. In addition, a hole 55 is defined in the driving member 54 and aligned with one of the closing sleeves 53 in the rotating wheel 50. A spring-biased driving rod 56 has an upper end slidably received in the hole 55 and includes a dome 56' in a portion of a lower end thereof. The dome 56' extends into the closing sleeve 53 aligned with the hole 55. A disc 51 is secured below the rotating wheel 50 and includes three through-holes 57, 58, and 59, wherein each through-hole 57, 58, 59 is aligned with an associated closing hole 52 and wherein the through holes 58 and 59 are with the ejection notch 47 of the lower mold seat 20. Referring to FIG. 6, a spring device 60 is provided below the lower mold seat 20 for mounting the rotating wheel 50 and the disc 51.

Figure 11:
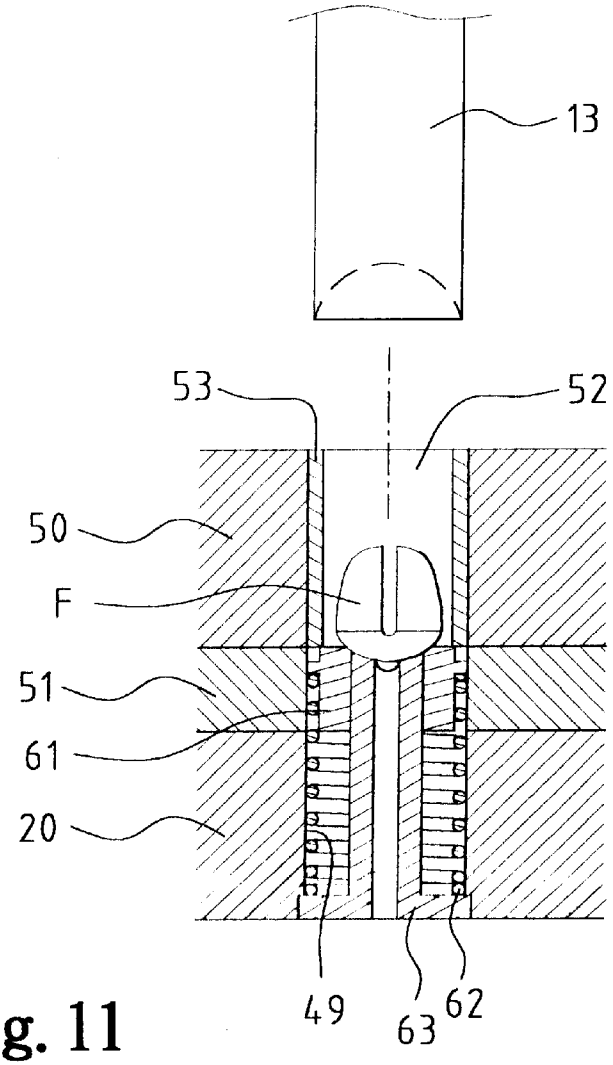
FIG. 11 is an enlarged sectional view illustrating closing of the jingling bell in the rotating wheel.

Referring to FIGS. 3 and 11, an anchor member 63 is received in the hole 49 of the lower mold seat 20 and the through-hole 57 in the disc 51. A spring 62 is mounted around the anchor 63, and a padding sleeve 61 is mounted in the through-hole 57 of the disc and between an upper end of the anchor 63 and the spring 62.

Referring to FIG. 2, the push seat 64 is slidably mounted on top of the seat 22 and includes a rotor 65 rotatably attached to each of two ends thereof and a push member 68 projected from a mediate portion thereof. The push member 68 slidably extends through the guide groove 32. In addition, two returning springs 66 are attached between the fifth mold seat 35 and the push seat 64, as shown in FIG. 2.

Figure 4:
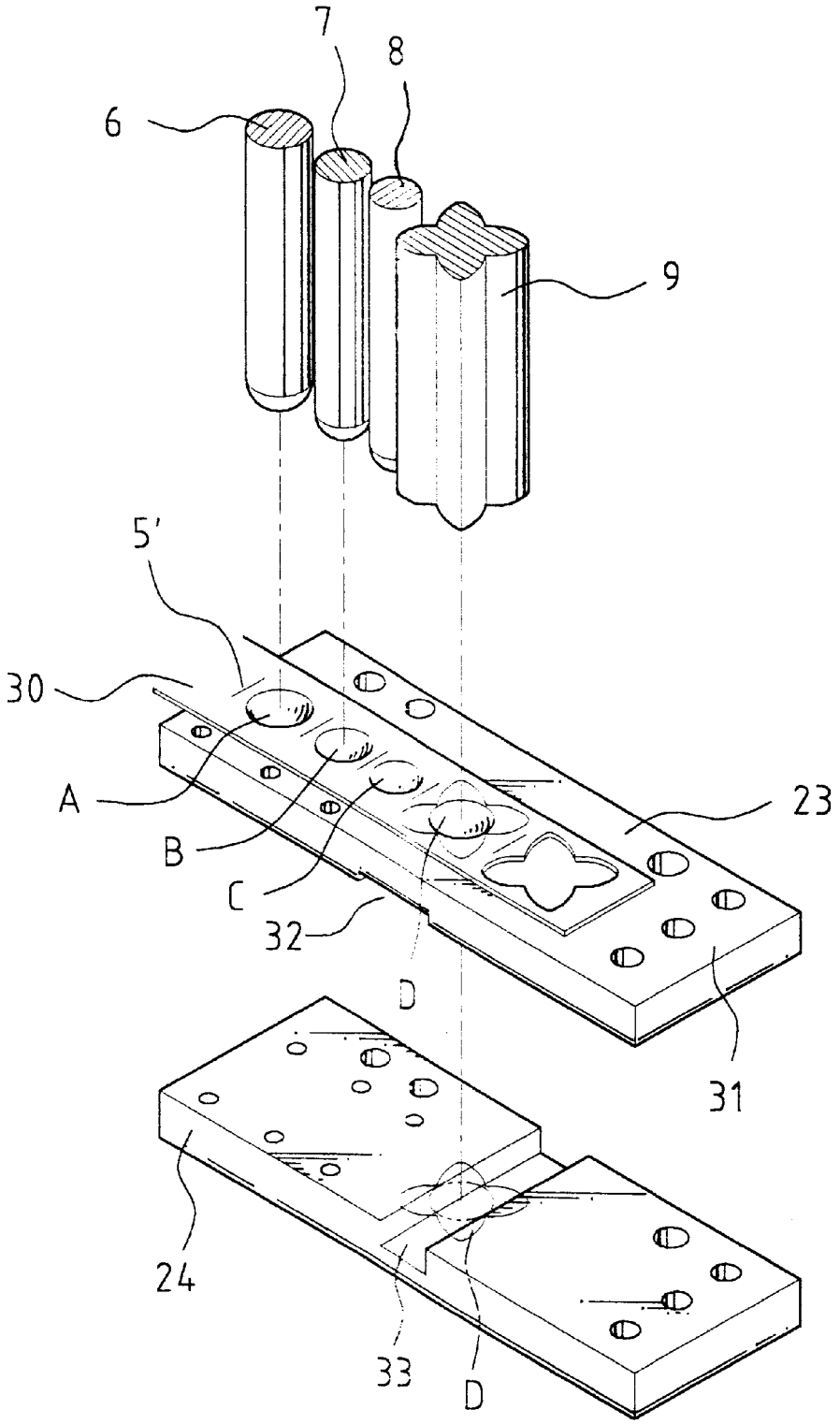
FIG. 4 is an exploded perspective view of a first mold plate, a second mold plate, and some punching pins of the lower mold assembly, illustrating initial punching steps for producing jingling bells.
Figure 12:
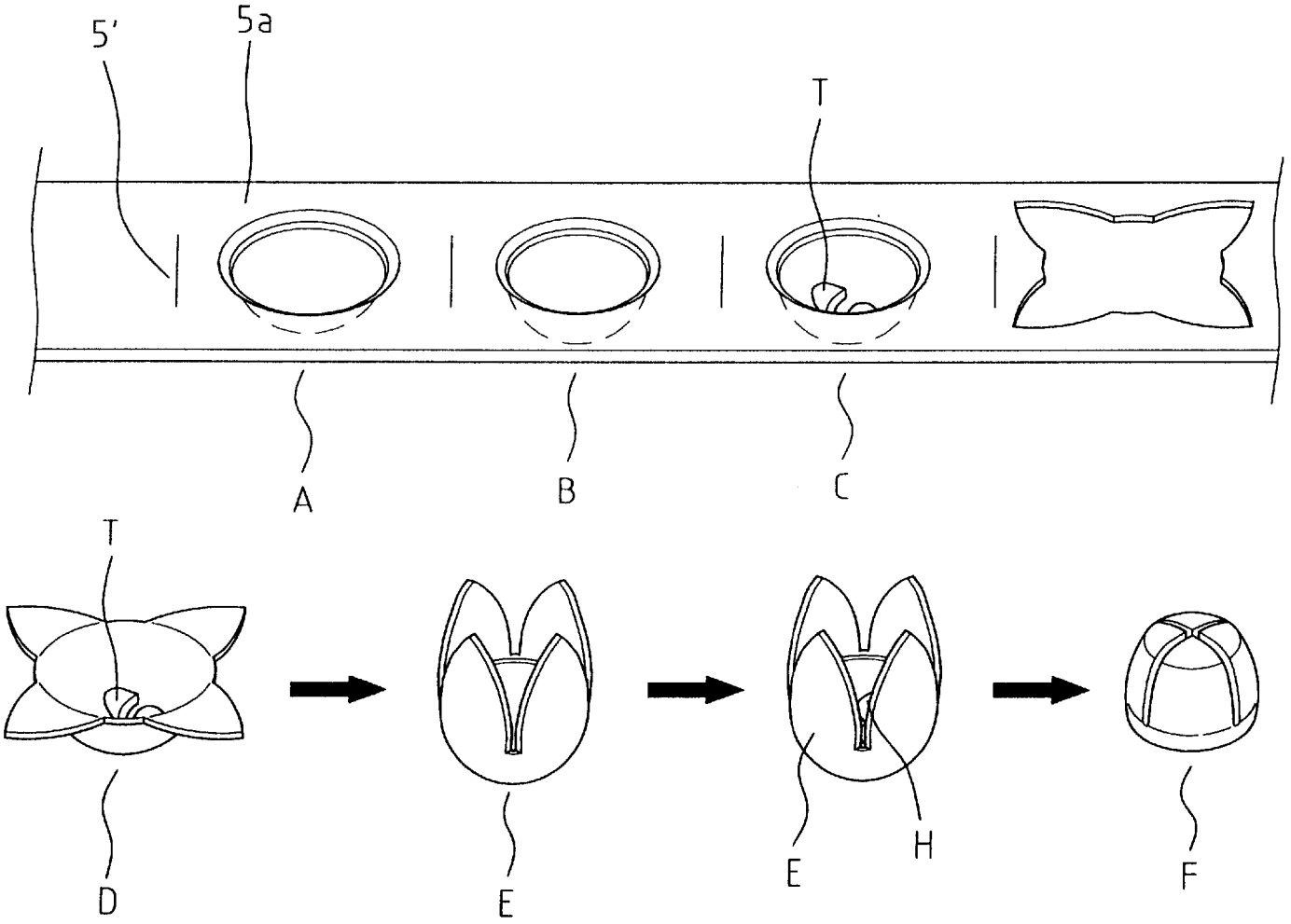
FIG. 12 is a schematic diagram illustrating the procedure of producing a jingling bell.

In operation, the upper mold seat 2 is moved up and down to proceed with the required punching effect in every stage. Referring first to FIG. 4, a material web 5*a* is fed to an upper side of the first mold plate 23 via the material inlet 30. The upper mold seat 2 moves downwardly such that the cutter 5 forms a groove 5' in the material web 5*a* to prevent from undesired deformation of the material web 5 a during the subsequent punching procedures. The material web 5*a* is then displaced to a location above the shallow groove 26, and the shallow punch pin 6 punches the material web 5*a* to form a shallow depression A (FIG. 12). Next, material web 5*a* is displaced to a location above the deep groove 26, and the deep punch pin 7 punches the shallow depression A of the material web 5*a* to form a deep depression B (FIG. 12). Next, the material web 5*a* is displaced to a location above the tie-piece punch groove 28, and the tie-piece punch pin 8 punches the deep depression B of the material web 5*a* to form a tie-piece T in the deep depression (now designated by C, FIG. 12). Next, material web 5*a* is then displaced to a location above the wings-punch hole 29, and the wings-punch pin 9 punches the deep depression C of the material web 5*a* to form a star-shape semi-product D for a jingling bell (FIG. 12). The star-shape semi-product D separates from the material web 5*a* and is carried through the guide groove 32 by the wings-punch pin 9 and thus falls on the material path 33. The waste material exits the first mold plate 23 via the waste material outlet 31.

Figure 5:
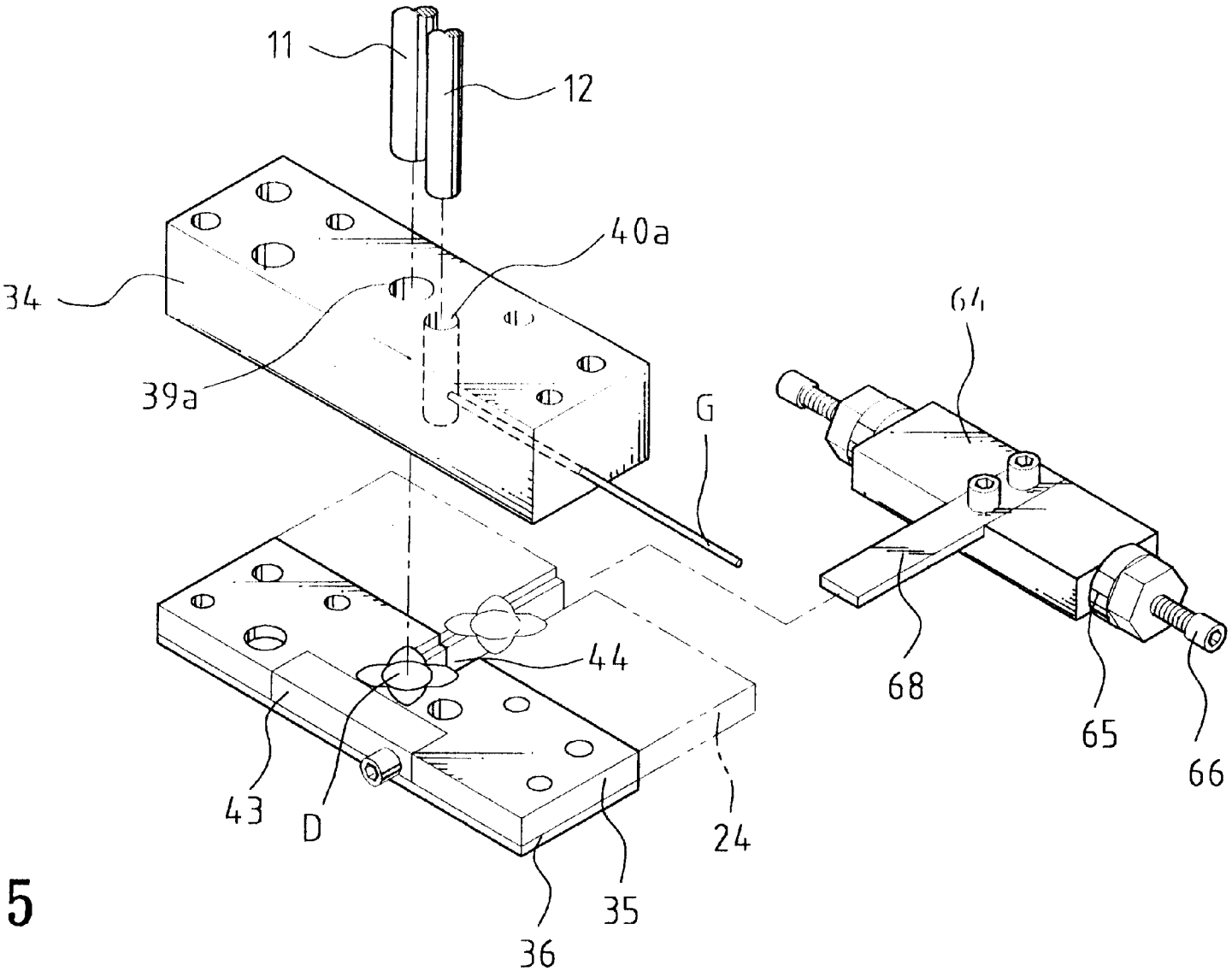
FIG. 5 is an exploded perspective view of a fourth mold plate, a fifth mold plate, and a push seat of the lower mold assembly, illustrating travel of a star-shape semi-product of a jingling bell.

Referring to FIGS. 1 and 5, during the downward travel of the upper mold seat 2, the guide faces 18 of the actuating member 17 impinge the rotors 65 of the push seat 64 to move the push seat 64 away from the lower mold seat 20. When the upper mold seat 2 moves upwardly, the returning springs 66 move the push seat 64 toward the lower mold seat 20 such that the push member 68 pushes the star-shape semi-product D from the material path 33 into the track 44 until the star-shape semi-product D is stopped by the stop 43. The star-shape semi-product D is now located above the closing hole 39*b*. In the next downward movement of the upper seat 2, the straightening punch pin 11 punches the star-shape semi-product D to straighten the legs (not labeled) of the semi-product D, thereby forming a flower-like semi-product E (FIGS. 6 and 12). The semi-product E falls into a closing sleeve 53 in a closing hole 52.

Figure 7:
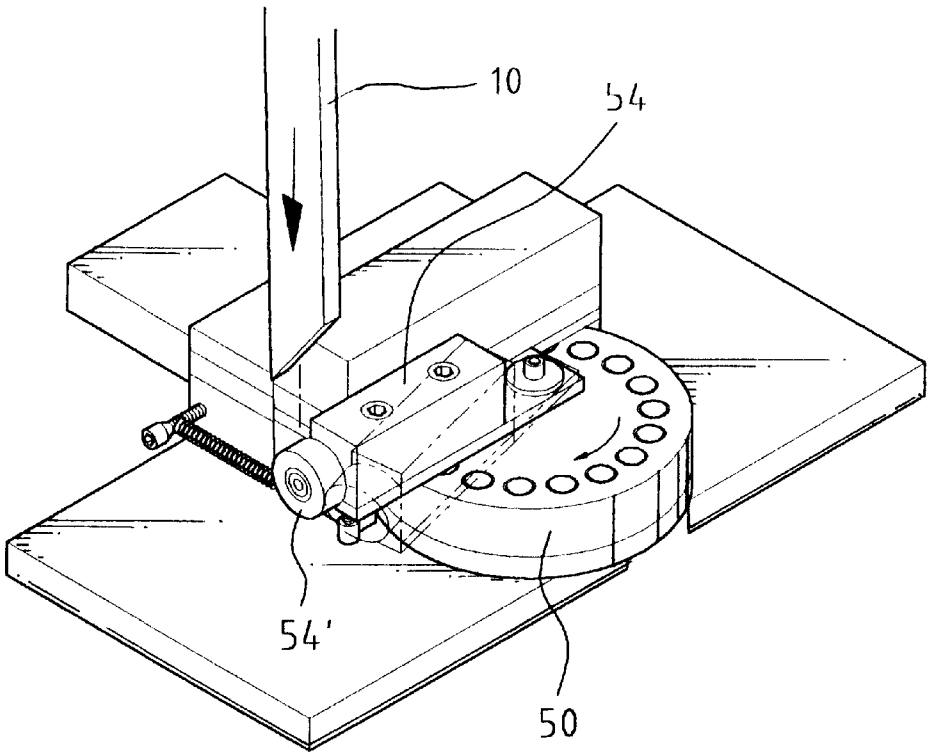
FIG. 7 is a perspective view illustrating rotation of the rotating wheel.
Figure 9:
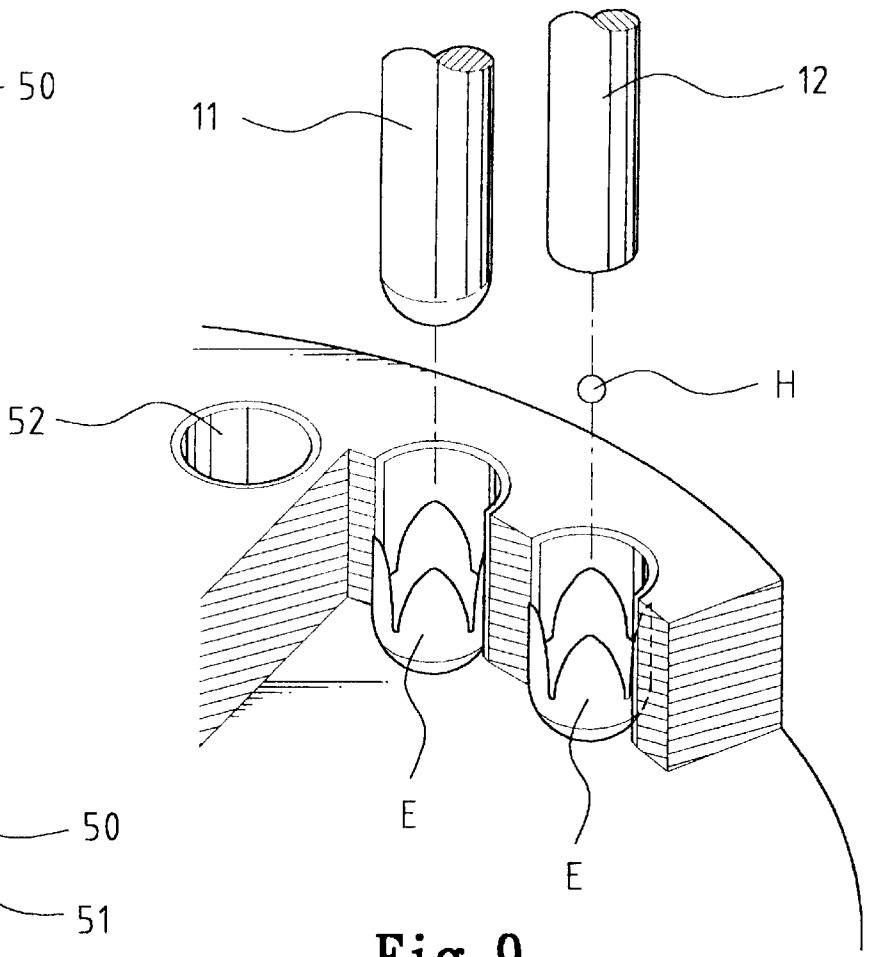
FIG. 9 is a partial perspective view of the rotating wheel, illustrating adding of the jingling member.
Figure 8A:
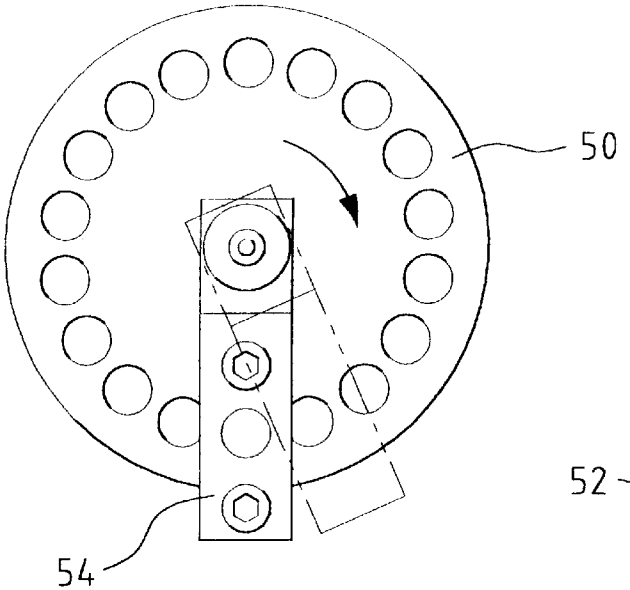
FIG. 8A is a top view illustrating rotation of the rotating wheel.
Figure 8B:
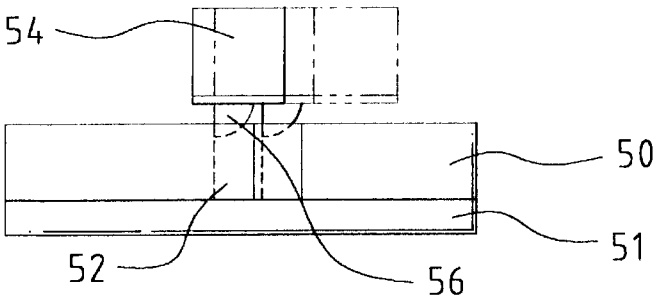
FIG. 8B is a front elevational view of the rotational wheel in FIG. 8A.
Figure 10:
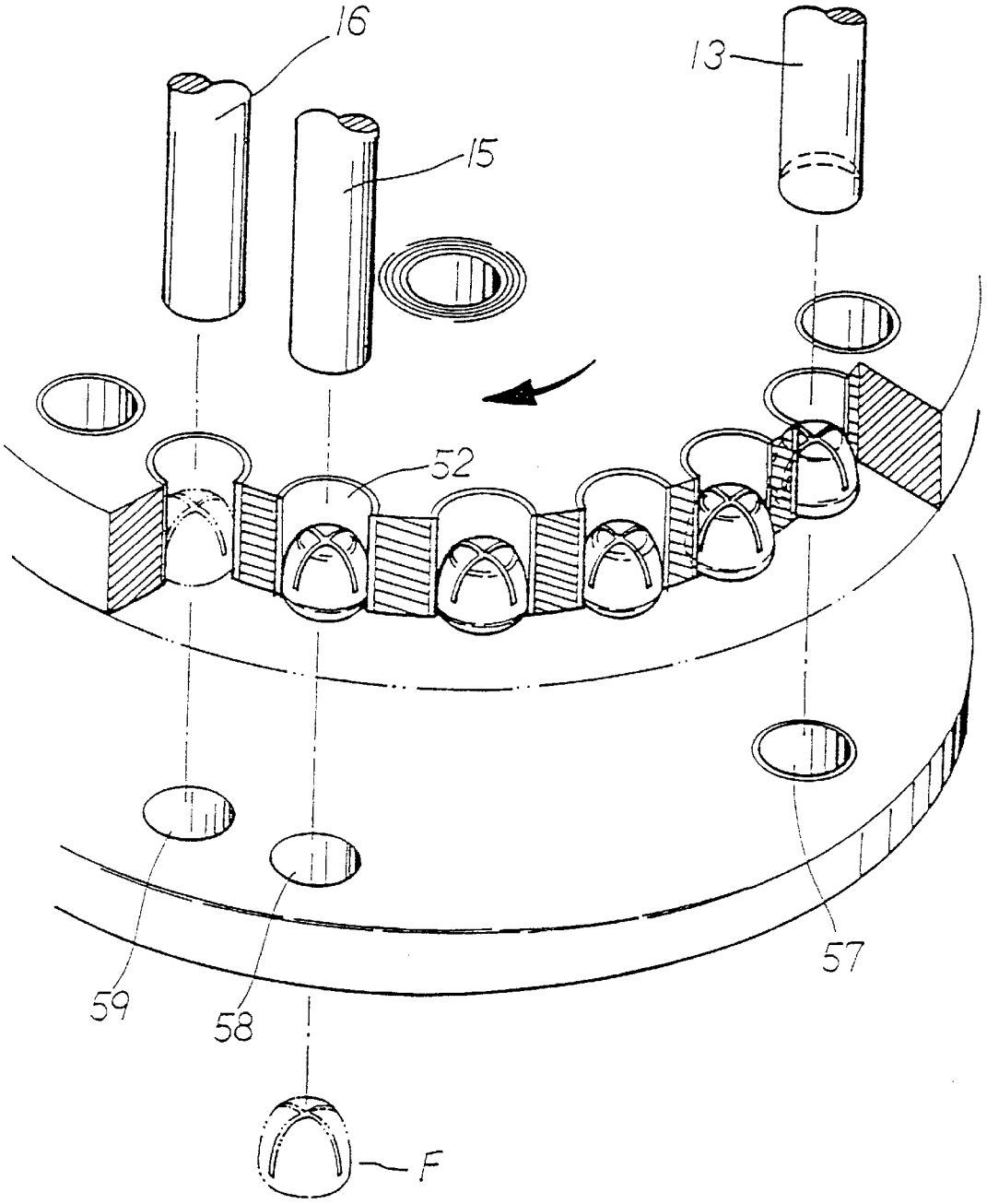
FIG. 10 is an enlarged partial perspective view of the rotating wheel, illustrating ejection of the jingling bell after production.

Referring to FIGS. 7, 8*a*, and 8*b*, during the downward travel of the upper mold seat 2, a slanted surface of the actuating block 10 impinges the rotor 54' of the driving member 54 to make the driving member 54 rotate counterclockwise by a distance equal to a distance between the centers of two adjacent closing holes 52. It is noted that the driving rod 56 is moved counterclockwise from the closing sleeve 53 in a closing hole 52 to the closing sleeve 53 in the adjacent closing hole 52 due to provision of the dome 56'. When the upper mold seat 2 moves upwardly, the spring 55' attached between the driving member 54 and the third mold plate 25 returns the driving member 54 and causes the rotating wheel 50 to rotate clockwise by a distance equal to a distance between the centers of two adjacent closing holes 52. In addition, the positioning member 45 with a dome 45' in the fourth mold plate 34 provides a positioning effect for each stroke of the upper mold seat 2 (including upward stroke and downward stroke) to assure that the rotating wheel 50 is displaced exactly by the above-mentioned distance. After the rotational movement of the rotating wheel 50 by the above-mentioned distance, the flower-like semi-product E in the rotating wheel 50 is displaced to a location below the through-hole 40*b* in the sixth mold plate 36. An iron wire G (FIG. 5) is fed into the through-hole 40*a* via the transverse hole 41 in the fourth mold plate 34, and the cutter 12 moves downwardly during the downward stroke of the upper mold seat 2 to cut a small piece from the iron wire to thereby form a jingling member H that falls into the flower-like semi-product E via a through hole 40*c* in the fifth mold plate 35 and the through-hole 40*b* in the sixth mold plate 36, as shown in FIGS. 6, 9, and 12.

Next, the rotating wheel 50 is turned clockwise by the above-mentioned distance under the action of the driving member 54 during the subsequent upward stroke of the upper mold seat 2, the flower-like semi-product E with a jingling member H is shifted to a location above the through-hole 57 of the disc 51, and the closing punch pin 13 is moved downwardly during the next downward stroke of the upper mold seat 2 to punch and thus close the semi-product E, thereby forming a jingling bell F, as shown in FIGS. 11 and 12.

Thereafter, the rotating wheel 50 is turned clockwise again by the above-mentioned distance under the action of the driving member 54 during the subsequent upward stroke of the upper mold seat 2, the jingling bell F is moved to a location below the displacement pin 14. The displacement pin 14 punches the jingling bell F to a position flush with an underside of the rotating wheel 50 during the subsequent downward stroke of the upper mold seat 2. Referring to FIG. 3, the rotating wheel 50 is then turned clockwise again by the above-mentioned distance under the action of the driving member 54 during the subsequent upward stroke of the upper mold seat 2, the jingling bell F is moved to a location above the ejection hole 58, the ejecting pin 15 punches the jingling bell F out of the rotating wheel 50 during the subsequent downward stroke of the upper mold seat 2, thereby ejecting the jingling bell F via the ejection notch 4. If the jingling bell F is not ejected in this punching procedure, the rotating wheel 50 is then turned clockwise again by the above-mentioned distance under the action of the driving member 54 during the subsequent upward stroke of the upper mold seat 2, the jingling bell F is moved to a location above the spare ejection hole 59, the spare ejecting pin 16 punches the jingling bell F out of the rotating wheel 50 during the subsequent downward stroke of the upper mold seat 2, thereby ejecting the jingling bell F via the ejection notch 4.

According to the above description, it is appreciated that the apparatus in accordance with the present invention may continuously produce jingling bells without manual operation. This is highly productive and cost saving.

Although the invention has been explained in relation to its preferred embodiment, it is to be understood that many other possible modifications and variations can be made without departing from the spirit and scope of the invention as hereinafter claimed.

What is claimed is:

1. An apparatus for continuously producing jingling bells, comprising an upper mold assembly (1) and a lower mold assembly (19), the upper mold assembly (1) comprising:

an upper mold seat (2) having a front section and a rear section, a front punch board (4) fixed to the front section of the upper mold seat, a shallow punch pin (6), a deep punch pin (7), a tie-piece punch pin (8), and a wings-punch pin (9) being mounted to the front punch board (4) in sequence, and a rear punch board (10) fixed to the rear section of the upper mold seat, a straightening punch pin (11), a jingling member cutter (12), a closing punch pin (13), and an ejection pin (15) being mounted to the rear punch board (10) in sequence, the lower mold assembly (19) comprising:

a lower mold seat (20) including a front section, a rear section, an ejection notch (47), and a hole (49), a first mold plate (23), a second mold plate (24), and a third mold plate (25) being securely mounted to the front section of the lower mold seat (2) and stacked from top to bottom in sequence, the first mold plate (23) including a shallow groove (26), a deep groove (27), a tie-piece punch groove (28), and a wings-punch hole (29) arranged in sequence in an upper side thereof and respectively located below the shallow punch pin (6), the deep punch pin (7), the tie-piece punch pin (8), and the wings-punch pin (9), the first mold plate (23) including a first end that defines a material inlet (30) and a second end that defines a waste material outlet (31), the second mold plate (24) including a material groove (33) in an upper side thereof and below the wings-punch hole (29) in the first mold plate (23), a fourth mold plate (34), a fifth mold plate (35), a sixth mold plate (36), and a seventh mold plate (37) being securely mounted to the rear section of the lower mold seat (20) and stacked from top to bottom in sequence, the fourth mold plate (34) and the sixth mold plate (36) including first aligned holes (39*a* and 39*b*) that are aligned with the closing punch pin (11), the fifth mold plate (35) including a track (44) aligned with the first aligned holes (39*a* and 39*b*) of the fourth mold plate (34) and the sixth mold plate (36), the fourth mold plate (34), the fifth mold plate (35), and the sixth mold plate (36) further including second aligned holes (40*a*, 40*c*, and 40*b*) that are aligned with the cutter (12), the fourth mold plate (34) further including a transverse hole (41) communicated with the second aligned hole of the fourth mold plate hole (40*a*), an iron wire (G) being fed to the first and second aligned holes hole (40*a*) via the transverse hole (41), the seventh mold plate (37) including an arcuate recess (46) below the holes (39*a*, 39*b*, 40*a*, 40*b*, and 40*c*), a rotating wheel (50) rotatably mounted to the lower mold seat (20) and including a plurality of annularly disposed closing holes (52), each said closing hole (52) receiving a closing sleeve (53) therein, and some of the closing holes (52) being located in the arcuate recess (46) of he seventh mold plate (37), a disc (51) secured between the rotating wheel (50) and the lower mold seat (20) and including a through-hole (57) and an ejection hole (58), each of the through hole (57) and the ejection hole (58) being aligned with an associated said closing hole (52) in the rotating wheel (50), and an anchor member (63) received in the hole (49) of the lower mold seat (20) and the through-hole (57) in the disc (51), the upper mold seat (2) being reciprocatingly movable through an upward stroke and a downward stroke relative to the lower mold seat (19), whereby a material web (5*a*) is fed to pass through the upper side of the first mold plate (23) via the material inlet (30) and exits via the waste material outlet (31), and in the downward stroke of the upper mold seat (2): (a) the shallow punch pin (6) punches the material web (5*a*) to form a shallow depression (A); (b) the deep punch pin (7) punches the shallow depression (A) of the material web (5*a*) formed in a previous punching procedure to form a deep depression (B); (c) the tie-piece punch pin (8) punches the deep depression (B) of the material web (5*a*) formed in the previous punching procedure to form a tie-piece (T) in the deep depression (C); (d) the wings-punch pin (9) punches the deep depression (C) of the material web (5*a*) formed in the previous punching procedure to form a star-shape semi-product (D) for a jingling bell, the star-shape semi-product (D) separates from the material web (5*a*) and then falls on the material path (33) of the second mold plate (24), further comprising:

means for displacing the star-shape semi-product (D) in the material path (33) of the second mold plate (24) into the track (44) of the fifth mold plate (35) during the upward stroke of the upper mold seat (2), and means for driving the rotating wheel (50) to rotate along a direction by a distance equal to a distance between the centers of two adjacent said closing holes (52) during the upward stroke of the upper mold seat (2), whereby in the downward stroke of the upper mold seat (2): (e) the straightening punch pin (11) punches the star-shape semi-product (D) formed in the previous punching procedure to form a flower-like semi-product (E) that then falls into the closing sleeve (53) in the associated said closing hole (52) via the first aligned hole (39*b*) of the sixth mold plate (36); (f) the rotating wheel (50) is rotated along the rotational the direction by said distance such that the semi-product (E) formed in the previous punching procedure is shifted to a position below the second aligned hole (40*b*) of the sixth mold plate (36); (g) the cutter (6) cuts the iron wire (G) to thereby form a jingling member (H) that then falls into flower-like semi-product (E) via the second aligned holes of the fifth and sixth mold plates (40*b* and 40*c*); (h) the flower-like semi-product (E) with the jingling member (H) formed in the previous punching procedure is shifted to a position above the through-hole (57) of the disc (51) during the rotational movement of the rotating wheel (50); (i) the closing punch pin (13) punches and thus closes the flower-like semi-product (E) with the jingling member (H) therein to thereby form a jingling bell (F); (j) the jingling bell (57) formed in the previous punching procedure is shifted to a position above the ejection hole (58) of the disc (51) during the rotational movement of the rotating wheel; and (k) the ejecting pin (15) ejects the jingling bell (F) in the associated closing hole (52) above the ejection hole (58) out of the rotating wheel (50) to thereby eject the jingling bell (F) via the ejection notch (47).

2. The apparatus for continuously producing jingling bells as claimed in claim 1, further comprising a second cutter (5) mounted to the upper mold seat (2) and beside the front punch board (4), the second cutter (5) forming a groove (5') in an upper side of the material web (5*a*) during the downward stroke of the upper mold seat (2) to avoid deformation of the material web (5*a*) in subsequent punching procedures.

3. The apparatus for continuously producing jingling bells as claimed in claim 1, further comprising a displacing pin (14) on the rear punch board (10) and between the closing punch pin (13) and the ejecting pin (15), the displacing pin (14) moving the jingling bell (F) to a position such that a portion of the jingling bell is flush with an underside of the rotating wheel (50).

4. The apparatus for continuously producing jingling bells as claimed in claim 1, further comprising a spare ejecting pin (16) on the rear punch board (10) and behind the ejecting pin (15), and the disc (51) including a spare ejection hole (59) located below the spare ejection pin (15) and aligned with the associated closing hole (52).

5. The apparatus for continuously producing jingling bells as claimed in claim 1, wherein the displacing means for the star-shaped semi-product (D) includes a push seat (64) having a push member (68) slidable along the material path (33) of the second mold plate (24), the push seat (64) further including at least one rotor (65) rotatably attached thereto, and wherein the upper mold plate (2) further includes at least one actuating member (17) that impinges on said at least one rotor (65) during the downward stroke of the upper mold seat (2) to move the push seat (64) away from the second mold plate (24), and at least one returning spring (66) being attached between the fifth mold plate (35) and the push seat (64) for moving the push seat (64) toward the second mold plate (24) during the upward stroke of the upper mold seat (2) such that the push member (68) pushes the star-shape semi-product (D) in the material path (33) into the track (44) of the fifth mold plate (35).

6. The apparatus for continuously producing jingling bells as claimed in claim 1, wherein the fifth mold plate (35)

further comprises a stop (43) for stopping the star-shape semi-product (D) pushed by the push member (68) at a location below the first aligned hole (39*a*) of the fourth mold plate (34).

7. The apparatus for continuously producing jingling bells as claimed in claim 1, further comprising means for guiding the upward stroke and the downward stroke of the upper mold seat (2) relative to the lower seat (20).

8. The apparatus for continuously producing jingling bells as claimed in claim 7, wherein the guiding means includes two spaced tubes (3) on the upper mold seat (2) and two spaced guide rods (21) on the lower mold seat (20) slidably extended through the tubes (3).

9. The apparatus for continuously producing jingling bells as claimed in claim 1, further comprising a spring (62) mounted around the anchor (63) and a padding sleeve (61) mounted in the through-hole (57) of the disc (51) and between the anchor (63) and the anchor spring (62).

10. The apparatus for continuously producing jingling bells as claimed in claim 1, wherein the driving means includes:

an actuating block (10') mounted to the upper mold seat (2) and beside the rear punch board (10), a driving member (54) including a first end rotatably mounted to the lower mold seat (20) and having a rotating axis coincident with that of the rotating wheel (50), the first end of the driving member (54) being located above the rotating wheel (50), the driving member (54) further including a second end to which a rotor (54') is rotatably mounted, a hole (55) being defined in the driving member (54) and aligned with one of the closing sleeves (53) in the rotating wheel (50), a spring-biased driving rod (56) having an upper end slidably received in the hole (55) and including a dome (56') in a portion of a lower end thereof, the dome (56') being extended into the closing sleeve (53) aligned with the hole (55), the rotor (54') being impinged by the actuating block (10') on the upper mold seat (2) during the downward stroke of the upper mold seat (2) to make the driving member (54) turn in a direction opposite to the rotational direction of the rotating wheel (50), such that the dome (56') of the driving rod (56) allows the lower end of the driving rod (56) to move from the closing sleeve (53) in one of the closing holes (52) to the closing sleeve (53) in the adjacent closing hole (52), and a spring (55') attached between the driving member (54) and the third mold plate (25) for returning the driving rod (56) such that the rotating wheel (50) is rotated in the direction of rotation by the distance during the upward stroke of the upper mold seat (2).

11. The apparatus for continuously producing jingling bells as claimed in claim 10, wherein the fourth mold plate (34), the fifth mold plate (35), and the sixth mold plate (36) include third aligned holes (38*a*, 38*b*, and 38*c*) that are aligned with the associated closing sleeve (53), and further comprising:

a spring-biased positioning member (45) including an upper end slidably received in the third aligned hole (38*a*) of the fourth mold plate (34) and a dome (45') in a portion of a lower end thereof, the dome (45') being extended into the closing sleeve (53) aligned with the third aligned holes (38*a*, 38*b*, and 38*c*), the dome (45') of the positioning member (45) allowing the lower end of the positioning member (45) to move from the closing sleeve (53) in one of the closing holes (52) to the closing sleeve (53) in the adjacent closing hole (52) when the rotational wheel (50) is rotated in the direction of rotation, thereby assuring the rotational wheel (50) is displaced by the distance.

* * * * *